US006265371B1

(12) United States Patent
Hagino et al.

(10) Patent No.: US 6,265,371 B1
(45) Date of Patent: Jul. 24, 2001

(54) POWDERY DETERGENT COMPOSITION CONTAINING A PARTIALLY NEUTRALIZED CHELANT

(75) Inventors: Genjiro Hagino, Tokyo; Shuji Tagata; Sachiko Noguchi, both of Wakayama, all of (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 09/462,265

(22) PCT Filed: Jul. 10, 1998

(86) PCT No.: PCT/JP98/03110

§ 371 Date: Jan. 6, 2000

§ 102(e) Date: Jan. 6, 2000

(87) PCT Pub. No.: WO99/03969

PCT Pub. Date: Jan. 28, 1999

(30) Foreign Application Priority Data

Jul. 18, 1997 (JP) ..... 9-194018

(51) Int. Cl.[7] ..... C11D 3/30

(52) U.S. Cl. ..... 510/480; 510/509; 510/485; 510/531; 510/532; 510/533; 510/534; 510/276; 510/289; 510/300; 510/315; 510/334; 510/367; 510/377; 510/443; 510/444; 510/507

(58) Field of Search ..... 510/480, 509, 510/485, 531, 532, 533, 534, 276, 289, 300, 315, 334, 367, 377, 443, 444, 507

(56) References Cited

U.S. PATENT DOCUMENTS

| | | | | |
|---|---|---|---|---|
| 3,546,123 | | 12/1970 | Stahlheber et al. | 252/137 |
| 3,637,511 | | 1/1972 | Yang | 252/527 |
| 5,019,296 | | 5/1991 | Baur et al. | 252/546 |
| 5,786,313 | * | 7/1998 | Schneider et al. | 510/219 |
| 5,804,541 | * | 9/1998 | Jans | 510/214 |
| 5,817,864 | * | 10/1998 | Greindl et al. | 560/171 |
| 5,968,884 | * | 10/1999 | Gopalkrishnan et al. | 510/361 |
| 5,994,290 | * | 11/1999 | Potthoff-Karl et al. | 510/531 |

FOREIGN PATENT DOCUMENTS

| | | |
|---|---|---|
| WO9612784 | 5/1995 | (EP) . |
| WO9630479 | 10/1996 | (EP) . |
| 50-3979 | 1/1975 | (JP) . |
| 50-8441 | 4/1975 | (JP) . |
| 55-157695 | 12/1980 | (JP) . |
| 55-160099 | 12/1980 | (JP) . |
| 56-813 | 7/1981 | (JP) . |
| 63-267751 | 11/1988 | (JP) . |
| 1-311197 | 12/1989 | (JP) . |
| 10-1660 | 1/1998 | (JP) . |
| 9-176694 | 7/1998 | (JP) . |
| 97/19159 * | 5/1997 | (WO) . |

* cited by examiner

*Primary Examiner*—Mark Kopec
*Assistant Examiner*—Charles Boyer
(74) *Attorney, Agent, or Firm*—Birch, Stewart, Kolasch & Birch, LLP

(57) ABSTRACT

A powdery detergent composition having a high detergency and an excellent storage stability (caking resistance), and comprising (a) a chelating agent composed of a compound having an average degree of neutralization in a molecule of 20 to 70%, a molecular weight of 600 or less, the number of carboxyl groups contained in one molecule of 3 to 5, and a constant of a chelating stability with $Ca^{2+}$ of 6 to 13, (b) an alkali agent composed of a compound a 0.1% by weight aqueous solution or dispersion of which has the maximum pH of 10 or more at 20° C., at least 5 ml of 0.1 N HCl aqueous solution being required to adjust 1 liter of the aqueous solution or the dispersion to pH 9, and (c) a surfactant at specific ratios, respectively.

5 Claims, No Drawings

POWDERY DETERGENT COMPOSITION CONTAINING A PARTIALLY NEUTRALIZED CHELANT

This application is the national phase under 35 U.S.C. § 371 of PCT International Application No. PCT/JP98/03110 which has an International filing date of Jul. 10, 1998, which designated the United States of America.

FIELD OF THE INVENTION

The present invention relates to a powdery detergent composition. More specifically, it relates to a powdery detergent composition having a high detergency and an excellent storage stability (caking resistance).

PRIOR ART

A detergent for clothes contained before a phosphorus compound such as sodium tripolyphosphate as a sequestering agent. At present, a zeolite, crystalline sodium aluminosilicate is mainly used.

Nevertheless, since the zeolite sometimes cannot exhibit a satisfactory performance by the washing for a short period of time at a low temperature, it contains a polymeric dispersant such as a polycarboxylic acid type polymer or the like. This polymer has a function of sequestering at a low water temperature, but it involves a problem that a biodegradability is insufficient.

In recent years, studies on builders having an excellent biodegradability and an excellent sequestering performance have been made. For example, there are JP-A 50-3979, JP-A 55-157695, JP-A 55-160099, JP-A 56-81399, WO-9612784, WO- 9630479, U.S. Pat. No. 3,637,511 and the like. However, when a detergent is blended with these specific organic builders, there is a problem in the storage stability (caking resistance) of the detergent.

DISCLOSURE OF THE INVENTION

It is an object of the present invention to provide a granular detergent composition which contains high-performance water-soluble builders and which is excellent in the storage stability (caking resistance) while having a high detergency.

The present inventors have found that a detergent composition containing a water-soluble polycarboxylic acid chelating agent having a specific average degree of neutralization and an alkali agent in specific amounts respectively can solve the above-mentioned problems.

The present invention is to provide a granular detergent composition comprising (a) 1 to 50% by weight of a chelating agent composed of a compound having an average degree of neutralization in a molecule of 20 to 70%, a molecular weight of 600 or less, the number of carboxyl groups contained in one molecule of 3 to 5, and a constant of a chelating stability with $Ca^{2+}$ of 6 to 13, (b) 5 to 60% by weight of an alkali agent composed of a compound a 0.1% by weight aqueous solution or dispersion of which has the maximum pH of 10 or more at 20° C., at least 5 ml of a 0.1 N HCl aqueous solution being required to adjust 1 liter of the aqueous solution or the dispersion to pH 9, and (c) 5 to 50% by weight of a surfactant.

The components used in the present invention are described below.

The average degree of neutralization of the chelating agent as component (a) is 20 to 70%, preferably 30 to 60%. When the average degree of neutralization is less than 20%, the solubility of the powders is decreased, and no satisfactory washing ability is obtained. Meanwhile, when it is more than 70%, a hygroscopic property is increased, and properties of powders such as a caking resistance and the like are deteriorated to make difficult the handling. The "average degree of neutralization" here is an average of a degree of neutralization of an acid-type chelating agent with an alkali, and it is represented by the following equation:

$$\text{Average degree of neutralization (\%)} = \frac{\text{Number of salt-type carboxyl groups in overall component (a)}}{\text{Number of all carboxyl groups in overall component (a)}} \times 100$$

Further, the molecular weight of the chelating agent as component (a) is 600 or less, and the number of carboxyl groups contained in one molecule is 3 to 5. When the molecular weight of the chelating agent is more than 600 and the number of carboxyl groups contained in one molecule is 6 or more, an amount of metallic ions sequestered per unit gram of the chelating agent is decreased. Meanwhile, when the number of carboxyl groups in one molecule is 2 or less, no satisfactory chelating power is obtained.

Further, this chelating agent is one in which the constant of chelating stability with $Ca^{2+}$ is 6 to 13 from viewpoints of the detergency and the hygroscopic property. The "constant of chelating stability" is an index of a chelating power.

The constant of Ca chelating stability is determined by the following method.

A solution containing 0.1 mol/l of $NH_4Cl$—$NH_4OH$ (pH 10.0) is prepared as a buffer. All of sample solutions were prepared by using this buffer. In the measurement of the $Ca^{2+}$ concentration, an ion meter (920A manufactured by Orion Research Incorporated, U.S.A.) and a $Ca^{2+}$ ion electrode were used. First, a relation of a calcium chloride concentration and a potential of the electrode is found, and a calibration curve is formed. A solution ($5.36\times10^{-2}$ mol/l) of calcium chloride, and a solution ($5.36\times10^{-4}$mol/l) of a chelating agent sample are prepared. 1 ml of the calcium chloride solution is added to 100 ml of the chelating agent sample solution, and the solution is stirred for 5 min. The residual $Ca^{2+}$ concentration is measured by using the $Ca^{2+}$ ion electrode. Assuming the chelating agent forms a chelate complex with $Ca^{2+}$ at a ratio of 1:1, the constant of Ca chelating stability is determined by the following equation:

$$\text{The constant of chelating stability} = \log_{10}\left[\frac{[Ca]_{Total} - [Ca]}{[Ca]\{[L]_{Total} - ([Ca]_{Total} - [Ca])\}}\right]$$

[Ca]: residual concentration of metallic ions (mol/l)

$[L]_{total}$: initial concentration of a chelating agent (mol/l)

$[ca]_{total}$: initial concentration of metallic ions (mol/l)

An aminopolycarboxylic acid represented by the following structure is preferable as the above-mentioned chelating agent.

(I)

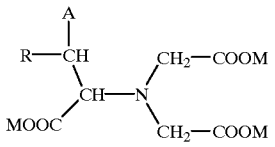

wherein R is —$(CH_2)_n$—A, A is H, OH or COOM, M is H, Na, K or $NH_4$ and n is 0 to 3.

Particularly, from a viewpoint of the biodegradability, partially neutralized substances such as N,N-bis(carboxymethyl)-2-aminopentandioic acid, N,N-bis(carboxymethyl)-2-aminobutandioic acid, N,N-bis(carboxymethyl)-2-aminopropanoic acid, N,N-bis(carboxymethyl)-2-amino-3-hydroxypropanoic acid and the like are preferable. The partially neutralized substance such as N,N-bis(carboxymethyl)-2-aminopentanoic acid or N,N-bis(carboxymethyl)-2-amino-3-hydroxypropanoic acid is particularly preferable.

The content of these chelating agents is 1 to 50% by weight, preferably 2 to 40% by weight, further preferably 2.5 to 30% by weight in the composition. When it is less than 1% by weight, no satisfactory effect is provided. Further, when it is more than 50% by weight, amounts of an activator and other builders are relatively reduced, and no sufficient detergency is obtained.

The alkali agent as component (b) is, in the present invention, composed of a compound in which a maximum pH of an aqueous solution or a dispersion having a concentration of 0.1% by weight (hereinafter referred to also as "maximum pH") is 10 or more (20° C.), and 5 ml or more of a 0.1 N HCl aqueous solution (hereinafter referred to also as an "amount of an HCl aqueous solution") are required to adjust 1 l of the aqueous solution or the dispersion to pH 9. When the maximum pH of the alkali agent is less than 10 or the amount of the HCl aqueous solution is less than 5 ml, no satisfactory detergency is provided.

Concrete examples of the alkali agent include crystalline silicates, amorphous silicates, alkali metal carbonates such as sodium carbonate, potassium carbonate, sodium sesquicarbonate, sodium hydrogencarbonate and the like, and amorphous alkali metal silicates such as JIS No. 1, No. 2 and No. 3 and the like, and phosphates such as tripolyphosphates. These alkali agents of inorganic salts are not only used as a neutralizer of a chelating agent but also effective for forming a structure of grains in drying a detergent, making it possible to obtain a relatively hard detergent having an excellent fluidity.

Further, the alkali agent as component (b) is blended in the composition in an amount of 5 to 60% by weight, preferably 10 to 50% by weight. When it is less than 5% by weight, the washing ability is poor, and it has an adverse effect on the solubility. Incidentally, the amount of the alkali agent is preferably more than an amount required to all neutralize an acid moiety of chelating agent (a) after adding and dissolving the composition in washing water. It is particularly preferable that the alkali agent is blended in such an amount that after the detergent composition is added to deionized water at a concentration of 0.067% with stirring for dispersion, the pH within 3 min does not become 10 or less.

As the alkali agent, a crystalline silicate is particularly preferable.

The crystalline silicate used in the present invention is excellent in the alkalinity, and differentiated from a crystalline aluminosilicate. As the crystalline silicate used in the present invention, a compound having a maximum pH of 11 or more is more preferable. Particularly preferable is a compound having the following composition:

$$X(M_2O).y(SiO_2).z(Me_mO_n).w\ (H_2O) \quad \text{(III)}$$

wherein M represents an element in the Ia group of the periodic table (particularly preferably K and/or Na), Me represents one or more (preferably Mg and Ca) selected from an element in the IIa group, an element in the IIb group, an element in the IIIa group, an element in the IVa group and an element in the VIII group of the periodic table, y/x is 0.5 to 2.6, z/x is 0.01 to 0.9, w is 0 to 20, and n/m is 0.5 to 2.0.

A method for producing the crystalline silicate represented by the formula (III) is conducted by reference to JP-A 7-89712.

Further, the crystalline silicate represented by the formula (IV) can preferably be used.

$$M_2O.x'(SiO_2).y'(H_2O) \quad \text{(IV)}$$

wherein M represents an alkali metal (particularly preferably K and/or Na), x' is 1.5 to 2.6 and y' is 0 to 20 (particularly preferably substantially 0).

The crystalline silicate of the formula (IV) is described in JP-A 60-227895, Phys. Chem. Glasses. 7, 127-138 (1966), Z. Kristallogr., 129, p.396–p.404 (1969) and the like. Further, its powders and granules are available from Hoechst Tokuyama Ltd. under a trade name, "Na-SKS-6" ($\delta$-$Na_2Si_2O_5$).

In the present invention, the content of the crystalline silicate is preferably 1 to 30% by weight, particularly preferably 3 to 25% by weight from a viewpoint of the detergency.

With respect to the surfactant as component (c), it is preferable that a cationic surfactant and a nonionic surfactant are mainly used.

Particularly, examples of the anionic surfactant include linear alkylbenzenesulfonates having 8 to 16 carbon atoms, alkanesulfonates (SAS), $^{\alpha}$-olefinsulfonates, sulfric esters of primary or secondary higher alcohols, $^{\alpha}$-sulfofatty esters, fatty acid salts derived from tallow or coconut oil and the like. Preferable examples of the nonionic surfactant include polyoxyethylene alkyl ethers having 8 to 22 carbon atoms, polyoxyethylene alkylphenyl ethers, higher fatty acid alkanolamides and adducts thereof with alkylene oxides, alkylamine oxides and the like. Further, an amino acid base surfactant as an amphoteric surfactant and a quaternary ammonium salt as a cationic surfactant can be used in combination.

The content of the surfactant is 5 to 50% by weight, preferably 15 to 45% by weight in the composition from viewpoints of the detergency and the easiness of the production.

It is advisable that the composition of the present invention contains a crystalline aluminosilicate (zeolite) as component (d). The crystalline aluminosilicate is represented by the following formula:

$$a'M_2O.Al_2O_3.b'(SiO_2).w(H_2O) \quad \text{(II)}$$

wherein M is an alkali metal atom, a', b' and w represent molar ratios of the components respectively, a' is $0.7 \leqq a' \leqq 1.5$, b' is $0.8 \leqq b' < 6$, and w is an optional positive number. Above all, those represented by the following formula (IIa):

$$Na_2O.Al_2O_3.n(SiO_2).w(H_2O) \quad \text{(IIa)}$$

(wherein, n is a number of 1.8 to 3.0, and w is a number of 1 to 6) are preferable. Synthetic zeolites having an average primary particle diameter of 0.1 to 10 μm, preferably 0.1 to 5 μm, such as A-type, X-type and P-type zeolites are preferably used. Zeolites may be blended in the form of powder and/or dry particles of zeolite agglomerate obtained by drying a zeolite slurry.

The content of the crystalline aluminosilicate is 1 to 40% by weight, preferably 5 to 30% by weight in the composition from viewpoints of the storage stability (caking resistance) and the solubility.

A particularly preferable detergent composition is that (a) is 2 to 40% by weight, (b) 10 to 50% by weight, (c) 15 to 45% by weight and (d) 5 to 30% by weight. The detergent composition of the present invention may contain the following components.

Carboxylic Acid Type Polymer

A carboxylic acid type polymer has an excellent sequestering performance, dispersibility of strain of a solid particle, and an antidespersition ability.

The carboxylic acid type polymer includes homopolymers or copolymerd of acrylic acid, methacrylic acid, itaconic acid and the like. A copolymer of the above-mentioned monomer and maleic acid is preferable, and the molecular weight is preferably 1,000 to 100,000.

Other examples include polymers such as polyglyoxylic acid salts, polyglycidylates and the like, cellulose compounds such as carboxymethyl cellulose and the like, and aminocarboxylic acid type polymers such as polyasparates.

The carboxylic acid-type polymer is blended in an amount of 1 to 20% by weight, preferably 2 to 10% by weight in the composition.

Bleaching Agent and Beach Activator

Examples of the bleaching agent include percarbonates, perborates (monohydrate is preferable), sulfate hydrogen peroxide adducts and the like. Particularly, sodium percarbonate is preferable, and sodium percarbonate coated with sodium borate is preferable.

Examples of the bleach activator include tetraacetylethylene diamine, acetoxybenzene sulfonate or carboxylate, organic peracid precursors described in JP-A 59-22999, JP-A 63-258447 or JP-A 6-316700, metallic catalysts in which transition metals are stabilized with a sequestering agent, and the like.

With respect to the bleaching agent and the bleaching activator, granules obtained separately are incorporated into a detergent material (grains) through dry-blending. The contents of the bleaching agent and the bleach activator are preferably 0.1 to 10% by weight in the composition.

Enzyme

Examples of the enzyme include hydrolases, oxidereductases, lyases, transferases and isomerases. Preferable are protease, esterase, lipase, nuclease, cellulase, amylase and pectinase. Especially preferable is a combined use of protease and cellulase.

The content of the enzyme is preferably 0.01 to 5% by weight in the composition.

Fluorescent Dye

The composition may contain one or more of 4,4'-bis-(2-sulfostyryl)-biphenyl salts, 4,4'-bis-(4-chloro-3-sulfostyryl)-biphenyl salts, 2-(styrylphenyl)naphtothiazole compounds, 4,4'-bis(triazol-2-yl)stilbene compounds and bis(triazinylamino)stilbene disulfonic acid compounds, in an amount of 0.01 to 2% by weight. For example, Whitex SA (manufactured by Sumitomo Chemical Co., Ltd.), Chinopal CBS (manufactured by Ciba-Geigy) etc. are available.

Oil Absorbing Carrier

A compound of which the oil absorbing ability according to JIS K6220is 100 ml/100 g or above (calculated as an anhydrous compound) is preferable. A silica type compound is preferably used. As the silica type compound, TOKSIL (manufactured by Tokuyama Soda Co., Ltd.), NIPSIL (Nippon Silica K.K.) or TIXOLEX (manufactured by Coflan Chemical) are available.

Further, the use of an amorphous aluminosilicate is particularly preferable from a viewpoint of the ion-exchange ability. (JP-A 6-179899)

Others

It is possible to blend a dispersant or a dyetransfer inhibitor such as polyethylene glycol, polyvinyl pyrrolidone, polyvinyl alcohol or the like, a filler such as sodium sulfate or the like, a defoaming agent of a silicone/silica type or the like, an antioxidant, a bluing agent, a perfume and the like.

The powdery detergent composition of the present invention is preferably a granular composition having a high bulk density. A high bulk density is imparted by, for example, a method of spraying a nonionic surfactant, water or the like on spray-dried particles, or a method of directly occluding non-ions in particles containing an oil-absorbing carrier. As a surface modifier of granules, an aluminosilicate may be added during the granulation or just before the completion thereof. Further, the chelating agent and the crystalline silicate may be added respectively when the high bulk density is imparted or by dry-blending. Still further, an alkali metal carbonate may be added during any of slurrying, the granulation and dry-blending. It is preferable that the chelating agent is added during the granulation, or granulated separately and then, dry-blended with detergent granules. In addition, it is preferable that the enzyme, the bleaching agent, the bleaching activator and other additives are granulated separately and then, dry-blended with detergent granules.

The average particle diameter of the granular detergent composition of the present invention is 200 to 1000 μm, particularly preferably 200 to 600 μm. The bulk density of the detergent composition of the present invention is 0.5 to 1.2 g/cm$^3$, preferably 0.6 to 1.0 g/cm$^3$.

SYNTHESIS EXAMPLE 1

Synthesis of disodium salt of N,N-bis (carboxymethyl)-2-aminopentandioic acid Having a Degree of Neutralization of 50%

Tetrasodium salt of N,N-bis(carboxymethyl)-2-aminopentandioic acid was obtained from glutamic acid, formalin and sodium cyanide by the method described in U.S. Pat. No. 2,500,019. The resulting product was neutralized with 36% hydrochloric acid to convert a part of the carboxylate to an acid type, and sodium chloride was removed by electrodialysis. N,N-bis(carboxymethyl)-2-aminopentandioic acid is found to be converted to a monosodium salt through neutralization titration using perchloric acid.

A dry product of disodium salt of N,N-bis (carboxymethyl)-2-aminopentandioic acid was obtained by adding 100 g of a 40% sodium hydroxide aqueous solution to 285 g of monosodium salt of N,N-bis(carboxymethyl)-2-aminopentandioic acid and, after the reaction, freeze-drying the reaction mixture. The identification of the average degree of neutralization was conducted by neutralization titration using perchloric acid, and $^{13}$C-NMR.

The other chelating agents were also produced and identified according to the above-mentioned scheme.

EXAMPLE 1

Preparation of a High Density Granular Detergent Composition

An aqueous slurry having a solid content of 60% was prepared from a crystalline aluminosilicate, a sodium linear alkylbenzenesulfonate, an acrylic acid/maleic acid copolymer, a sodium salt of fatty acid, sodium carbonate, sodium silicate No. 1, Glauber's salt, a fluorescent dye (4,4-bis(2-sulfostyryl)-biphenyl salt) and PEG, and spray-dried. The resulting powder was charged into a high-speed mixer, and disodium salt of N,N-bis(carboxymethyl)-2-aminopentandioic acid and a crystalline silicate were further added. While these were mixed, a polyoxyethylene alkyl ether heated at 70° C. was gradually added dropwise thereinto, and granulated.

Further, 30 seconds before the completion of the granulation, a crystalline aluminosilicate was added to obtain a granular detergent composition having a high density as Invention Product 1 (average particle diameter 450 "m, bulk density 800 g/liter).

Other high-density granular detergent compositions were prepared at blending ratios according to the above-mentioned scheme. Chelating agents (A) to (D) were used by being adjusted such that the average degrees of neutralization became values shown in Tables 1 to 4. Incidentally, none of the products of the present invention shown in Tables 1 and 2 had a pH of 10 or less for 3 min after adding these to 100 ml of deionized water at a ratio of 0.067% for mixing while being stirred.

Evaluation of a Performance

The rate of increase in weight, the rate of passage through a sieve and a detergency were measured by the following methods, and the results are shown in Tables 1 to 4.

The rate of increase in weight reflects the extent of the moisture absorption, and influences the rate of passage through a sieve. These evaluation results correlate with the caking property of the detergent. Accordingly, it is advisable that the rate of increase in weight is low, the rate of passage through a sieve is good and the detergency is excellent.

(1) Rate of Increase in Weight 1 g of detergent granules was charged on a petri dish, and stored for 40 days in an open constant temperature chamber under such acceleration conditions as to increase a moisture absorption (temperature 30° C., humidity 80%). After the storage, the petri dish was taken out, and the rate of increase in weight based on the weight before storage was determined by the following equation:

$$\text{rate of increase in weight (\%)} = \frac{\text{weight after storage} - \text{weight before storage}}{\text{weight before storage}} \times 100$$

(2) Rate of Passage Through a Sieve 500 g of a detergent powder were charged into a detergent carton, and stored in an open constant temperature chamber for 40 days under such acceleration conditions as to increase a moisture absorption (temperature 30° C., humidity 80%). After the storage, the carton was slowly inclined, and the detergent powder was silently dropped on a sieve, 5,000 $\mu$m in mesh size. At this time, the weight of the detergent passed through the sieve and the weight of the overall detergent after the storage were measured respectively, and the rate of passage through a sieve was calculated by the following equation:

$$\text{rate of passage through a sieve (\%)} = \frac{\text{weight of the detergent passed through the sieve}}{\text{weight of the overall detergent after the storage}} \times 100$$

(3) Detergency Test

Preparation of Artificially Stained Cloths

An artificially dirt liquid having the following composition was attached to a cloth by the use of a gravure roll coater. (cell capacity of gravure roll of 58 $cm^3/cm^2$, a coating speed of 1.0 m/min, a drying temperature of 100° C., and a drying time of 1 min. A cotton shirting cloth #2003 produced by Tanigashira Shoten Co., Ltd. was used.)

The composition of the artificial soiling dirt liquid was was that lauric acid 0.44% by weight, myristic acid 3.09% by weight, pentadecanoic acid 2.31% by weight, palmitic acid 6.18% by weight, heptadecanoic acid 0.44% by weight, stearic acid 1.57% by weight, oleic acid 7.75% by weight, trioleic acid 13.06% by weight, n-hexadecyl palmitate 2.18% by weight, squalene 6.53% by weight, crystal of egg white lecithin 1.94% by weight, Kanuma Aka-tsuchi 8.11% by weight, carbon black 0.01% by weight and the balance of tap water.

Washing Conditions and Evaluation Method

Five of the artificially soiled clothes having a size of 10 cm×10 cm prepared above were placed in 1 l of an aqueous detergent solution for evaluation, and these were washed at 100 rpm by a Terg-O-Tometer. Washing conditions were that a washing time 10 min, a detergent concentration 0.067%, a water hardness 71.4 mg $CaCO_3$/l and a water temperature 20° C., and the rinsing was conducted with tap water for 5 min.

The detergency was determined by measuring the reflectivities at 550 nm of the unstained cloths and the stained cloths before and after the washing by the use of a self-colorimeter (manufactured by Shimadzu Corporation), and the rate (%) of cleansing was calculated by the following equation. And the average rate of cleansing of five cloths is shown as the detergency.

$$\text{Rate of cleansing (\%)} = \frac{\text{Reflectivity after washing} - \text{Reflectivity before washing}}{\text{Reflectivity of unstained cloth} - \text{Reflectivity before washing}} \times 100$$

TABLE 1

| Components (wt %) | Product of the present invention | | | | | | | |
|---|---|---|---|---|---|---|---|---|
| | 1 | 2 | 3 | 4 | 5 | 6 | 7 | 8 |
| LAS *1 | 25 | 25 | 10 | 20 | 20 | 20 | 15 | 15 |
| AS *2 | | | | 5 | 5 | 5 | | |
| AE *3 | 5 | 5 | 5 | 5 | 5 | 5 | 10 | 10 |
| SFE *4 | | | 15 | | | | | |
| Sodium salt of tallow fatty acid | 3 | 3 | 3 | 3 | 3 | 3 | 1 | 1 |
| Chelating agent (A) *5 | 3 | 5 | 5 | 5 | 5 | 10 | 20 | 25 |
| Chelating agent (B) *6 | | | | | | | | |
| Chelating agent (C) *7 | | | | | | | | |
| Chelating agent (D) *8 | | | | | | | | |
| Citric acid | | | | | | | | |
| Crystalline silicate *9 | 6 | 8 | 8 | 8 | 8 | 15 | 15 | 15 |
| Sodium silicate No. 1 | 5 | 5 | 5 | 5 | 5 | 5 | 5 | 5 |
| Sodium carbonate | 10 | 10 | 10 | 10 | 20 | 10 | 10 | 10 |
| Potassium carbonate | 5 | 3 | | | | | | |
| Sodium sulfate (valance) | 7.5 | 5.5 | 8.5 | 8.5 | 8.5 | 1.5 | | |
| Polyethylene glycol *10 | 1 | 1 | 1 | 1 | 1 | 1 | 1 | 1 |
| Crystalline sodium aluminosilicate *11 | 20 | 20 | 20 | 20 | 10 | 15 | 15 | 10 |
| Polyacrylic acid *12 | | | | | | | 1.5 | 1.5 |
| Acrylic acid/maleic acid copolymer *13 | 3 | 3 | 3 | 3 | 3 | 3 | | |
| Enzyme *14 | 1 | 1 | 1 | 1 | 1 | 1 | 1 | 1 |
| Fluorescent dye *15 | 0.5 | 0.5 | 0.5 | 0.5 | 0.5 | 0.5 | 0.5 | 0.5 |
| Water | 5 | 5 | 5 | 5 | 5 | 5 | 5 | 5 |
| Total (%) | 100 | 100 | 100 | 100 | 100 | 100 | 100 | 100 |
| Average degree of neutralization of a chelating agent (%) | 50 | 50 | 50 | 25 | 50 | 50 | 50 | 50 |
| Rate of increase in weight (%) | 15 | 16 | 16 | 14 | 16 | 17 | 19 | 20 |
| Rate of passage through sieve (%) | 68 | 63 | 61 | 65 | 62 | 61 | 59 | 58 |
| Sebaceous soil detergency (%) | 56 | 59 | 59 | 58 | 59 | 60 | 65 | 68 |

TABLE 2

| Components (wt %) | Product of the present invention | | | | | |
|---|---|---|---|---|---|---|
| | 9 | 10 | 11 | 12 | 13 | 14 |
| LAS *1 | 20 | 20 | 20 | 20 | 20 | 20 |
| AS *2 | 5 | 5 | 5 | 5 | 5 | 5 |
| AE *3 | 5 | 5 | 5 | 5 | 5 | 5 |
| SFE *4 | | | | | | |
| Sodium salt of tallow fatty acid | 3 | 3 | 3 | 3 | 3 | 3 |
| Chelating agent (A) *5 | | | | | | |
| Chelating agent (B) *6 | 10 | 10 | | | | |
| Chelating agent (C) *7 | | | 10 | 10 | | |
| Chelating agent (D) *8 | | | | | 10 | 10 |
| Citric acid | | | | | | |
| Crystalline silicate *9 | 15 | 13 | 15 | 13 | 15 | 15 |
| Sodium silicate No. 1 | 5 | 5 | 5 | 5 | 5 | 5 |
| Sodium carbonate | 10 | 10 | 10 | 10 | 10 | 10 |
| Potassium carbonate | | | | | | |
| Sodium sulfate (valance) | 1.5 | 3.5 | 1.5 | 3.5 | 1.5 | 1.5 |
| Polyethylene glycol *10 | 1 | 1 | 1 | 1 | 1 | 1 |
| Crystalline sodium aluminosilicate *11 | 15 | 15 | 15 | 15 | 15 | 15 |
| Polyacrylic acid *12 | | | | | | |
| Acrylic acid/maleic acid copolymer *13 | 3 | 3 | 3 | 3 | 3 | 3 |
| Enzyme *14 | 1 | 1 | 1 | 1 | 1 | 1 |
| Fluorescent dye *15 | 0.5 | 0.5 | 0.5 | 0.5 | 0.5 | 0.5 |
| Water | 5 | 5 | 5 | 5 | 5 | 5 |
| Total (%) | 100 | 100 | 100 | 100 | 100 | 100 |
| Average degree of neutralization of a chelating agent (%) | 33 | 67 | 33 | 67 | 25 | 50 |
| Rate of increase in weight (%) | 14 | 18 | 13 | 17 | 15 | 16 |
| Rate of passage through sieve (%) | 64 | 59 | 65 | 60 | 64 | 62 |
| Sebaceous soil detergency (%) | 62 | 61 | 61 | 59 | 58 | 60 |

TABLE 3

| Components (wt %) | Comparative compound | | | | | |
|---|---|---|---|---|---|---|
| | 1 | 2 | 3 | 4 | 5 | 6 |
| LAS *1 | 20 | 20 | 10 | 20 | 20 | 20 |
| AS *2 | 5 | 5 | | 5 | 5 | 5 |
| AE *3 | 5 | 5 | 5 | 5 | 5 | 5 |
| SFE *4 | | | 15 | | | |
| Sodium salt of tallow fatty acid | 3 | 3 | 3 | 3 | 3 | 3 |
| Chelating agent (A) *5 | 5 | 5 | 5 | 0.5 | 10 | |
| Chelating agent (B) *6 | | | | | | 10 |
| Chelating agent (C) *7 | | | | | | |
| Chelating agent (D) *8 | | | | | | |
| Citric acid | | | | | | |

TABLE 3-continued

| Components (wt %) | Comparative compound 1 | 2 | 3 | 4 | 5 | 6 |
|---|---|---|---|---|---|---|
| Crystalline silicate *9 | 3 | 3 | 3 | 5 | 15 | 5 |
| Sodium silicate No. 1 | 5 | 5 | 5 | 5 | 5 | 5 |
| Sodium carbonate | 10 | 10 | 10 | 10 | 10 | 10 |
| Potassium carbonate | 5 | 5 | 5 | | | |
| Sodium sulfate (valance) | 8.5 | 8.5 | 8.5 | 16 | 1.5 | 11.5 |
| Polyethylene glycol *10 | 1 | 1 | 1 | 1 | 1 | 1 |
| Crystalline sodium aluminosilicate *11 | 20 | 20 | 20 | 20 | 15 | 15 |
| Polyacrylic acid *12 | | | | | | |
| Acrylic acid/maleic acid copolymer *13 | 3 | 3 | 3 | 3 | 3 | 3 |
| Enzyme *14 | | | | | | |
| Fluorescent dye *15 | 0.5 | 0.5 | 0.5 | 0.5 | 0.5 | 0.5 |
| Water | 5 | 5 | 5 | 5 | 5 | 5 |
| Total (%) | 100 | 100 | 100 | 100 | 100 | 100 |
| Average degree of neutralization of a chelating agent (%) | 0 | 75 | 100 | 50 | 0 | 100 |
| Rate of increase in weight (%) | 10 | 64 | 83 | 9 | 14 | 70 |
| Rate of passage through sieve (%) | 68 | 3 | 0 | 70 | 66 | 2 |
| Sebaceous soil detergency (%) | 58 | 56 | 58 | 48 | 56 | 61 |

TABLE 4

| Components (wt %) | Comparative compound 7 | 8 | 9 | 10 | 11 | 12 | 13 |
|---|---|---|---|---|---|---|---|
| LAS *1 | 20 | 20 | 20 | 20 | 20 | 20 | 20 |
| AS *2 | 5 | 5 | 5 | 5 | 5 | 5 | 5 |
| AE *3 | 5 | 5 | 5 | 5 | 5 | 5 | 5 |
| SFE *4 | | | | | | | |
| Sodium salt of tallow fatty acid | 3 | 3 | 3 | 3 | 3 | 3 | 3 |
| Chelating agent (A) *5 | | | | | | | |
| Chelating agent (B) *6 | | | | | | | |
| Chelating agent (C) *7 | 10 | 10 | | | | | |
| Chelating agent (D) *8 | | | 10 | 10 | 10 | | |
| Citric acid | | | | | | 5 | |
| Crystalline silicate *9 | 15 | 5 | 15 | 10 | 5 | 6 | 3 |
| Sodium silicate No. 1 | 5 | 5 | 5 | 5 | 5 | 5 | 5 |
| Sodium carbonate | 10 | 10 | 10 | 10 | 10 | 10 | 10 |
| Potassium carbonate | | | | | | | 5 |
| Sodium sulfate (valance) | 1.5 | 11.5 | 1.5 | 6.5 | 11.5 | 10.5 | 13.5 |
| Polyethylene glycol *10 | 1 | 1 | 1 | 1 | 1 | 1 | 1 |
| Crystalline sodium aluminosilicate *11 | 15 | 15 | 15 | 15 | 15 | 20 | 20 |
| Polyacrylic acid *12 | | | | | | | |
| Acrylic acid/maleic acid copolymer *13 | 3 | 3 | 3 | 3 | 3 | 3 | 3 |
| Enzyme *14 | 1 | 1 | 1 | 1 | 1 | 1 | 1 |
| Fluorescent dye *15 | 0.5 | 0.5 | 0.5 | 0.5 | 0.5 | 0.5 | 0.5 |
| Water | 5 | 5 | 5 | 5 | 5 | 5 | 5 |
| Total (%) | 100 | 100 | 100 | 100 | 100 | 100 | 100 |
| Average degree of neutralization of a chelating agent (%) | 0 | 100 | 0 | 75 | 100 | 67 | — |
| Rate of increase in weight (%) | 9 | 65 | 11 | 60 | 81 | 27 | 7 |
| Rate of passage through sieve (%) | 70 | 3 | 68 | 4 | 0 | 36 | 71 |
| Sebaceous soil detergency (%) | 56 | 60 | 55 | 58 | 60 | 49 | 45 |

TABLE 4-continued

| Components (wt %) | Comparative compound 7 | 8 | 9 | 10 | 11 | 12 | 13 |
|---|---|---|---|---|---|---|---|

(Notes)

*1: Sodium linear alkyl ($C_{12}$–$C_{13}$) benzenesulfonate

*2: Sodium alkyl ($C_{12}$–$C_{18}$) sulfonate

*3: Polyoxyethylene (average number of ethylene oxide molecules added: 8) alkyl ($C_{12}$–$C_{13}$) ether

*4: Sodium salt of α-sulfonic fatty acids (coconut fatty acids) methyl ester

*5: N,N-bis(carboxymethyl)-2-aminopentandioic acid ($Ca^{2+}$ chelating stability constant = 6.5)

*6: N,N-bis(carboxymethyl)-2-amino-3-hydroxypropanoic acid ($Ca^{2+}$ chelating stability constant = 8.0)

*7: N,N-bis(carboxymethyl)-2-aminopropanoic acid ($Ca^{2+}$ chelating stability constant = 6.3)

*8: N,N-bis(carboxymethyl)-2-aminobutandioic acid ($Ca^{2+}$ chelating stability constant = 7.0)

*9: Composition $M_2O.1.8SiO_2.0.02M'O$ (wherein M:Na, K, K/Na = 0.03, M' = Ca, Mg, Mg/Ca = 0.01), ion exchange capacity 290 $CaCO_3$ mg/g, average particle diameter 30 μm (a crystalline silicate represented by the formula (III))

*10: average molecular weight 7,000

*11: Composition $M_2O.Al_2O_3.2SiO_2.2H_2O$, average particle diameter 4 μm, ion exchange capacity 290 $CaCO_3$ mg/g

*12: average molecular weight 8,000

*13: average molecular weight 70,000, acrylic acid/maleic acid = 7/3 (molar ratio)

*14: Enzyme (a mixture of Sabinase 12.0TW (manufactured by Novo Nordisc), Lipolase 100T (manufactured by Novo Nordisc), Celluzyme 0.1T (manufactured by Novo Nordisc) and Termamyl 60T (manufactured by Novo Nordisc) at a ratio of 2:1:1:1 (weight ratio))

*15: Fluorescent dye of Chinopal CBS (manufactured by Ciba-Geigy)/Whitex SA (manufactured by Sumitomo Chemical Co., Ltd.) = 1/1 (weight ratio)

What is claimed is:

1. A powdery detergent composition comprising:

(a) 1 to 50% by weight of a chelating agent composed of a compound having an average degree of neutralization in a molecule of 20 to 70%, a molecular weight of 600 or less, the number of carboxyl groups contained in one molecule of 3 to 5, and a constant of a chelating stability with $Ca^{2+}$ of 6 to 13, which is represented by the following formula (I):

(I)

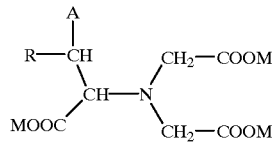

wherein R is —$(CH_2)_n$—A, A is H, OH or COOM, M is H, Na, K or $NH_4$ and n is 0 to 3; and (b) 5 to 60% by weight of an alkali agent composed of a compound, a 0.1% by weight aqueous solution or dispersion of which has a pH of at least 10 at 20° C., at least 5 ml of a 0.1 N HCl aqueous solution being required to adjust 1 liter of the aqueous solution or the dispersion to pH 9, and (c) 5 to 50% by weight of a surfactant.

2. The composition as claimed in claim 1, wherein the average degree of neutralization of the chelating agent (a) is 30 to 60%.

3. The composition as claimed in claim 1, wherein (b) comprises a crystalline silicate in an amount of 1 to 30% by weight.

4. The composition as claimed in claim 1, which further comprises 1 to 40% by weight of a crystalline aluminosilicate (d) represented by the following formula (II):

$$a'(M_2O).Al_2O_3.b'(SiO_2).w(H_2O) \quad \text{(II)}$$

wherein M is an alkali metal atom; a', b' and w represent molar ratios of the components, respectively; and a' is $0.7 \leqq a' \leqq 1.5$, b' is $0.8 \leqq b' \leqq 6$, and w is a positive number.

5. The composition as claimed in claim 1, wherein (a) is selected from the group consisting of N,N-bis (carboxymethyl)-2-aminopentandioic acid, N,N-bis (carboxymethyl)-2-aminobutandioic acid, N,N-bis (carboxymethyl)-2-aminopropanoic acid and N,N-bis (carboxymethyl)-2-amino-3-hydroxypropanoic acid.

* * * * *